US007315285B2

(12) United States Patent
Bancroft et al.

(10) Patent No.: US 7,315,285 B2
(45) Date of Patent: Jan. 1, 2008

(54) SINGLE FEED DUAL-BAND PIFA REALIZED ON CIRCUIT BOARD

(75) Inventors: Randy Bancroft, Denver, CO (US); Nathan Stutzke, Louisville, CO (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 125 days.

(21) Appl. No.: 11/163,760

(22) Filed: Oct. 28, 2005

(65) Prior Publication Data

US 2007/0096987 A1 May 3, 2007

(51) Int. Cl.
*H01Q 1/24* (2006.01)

(52) U.S. Cl. ..... 343/702; 340/700 MS

(58) Field of Classification Search ..... 343/700 MS, 343/702, 846, 853, 893
See application file for complete search history.

(56) References Cited

U.S. PATENT DOCUMENTS 6,774,851 B1 * 8/2004 Cuhaci et al. ..... 343/700 MS
6,850,198 B2 * 2/2005 Robin ..... 343/702
6,917,335 B2 * 7/2005 Kadambi et al. .... 343/700 MS
6,924,768 B2 * 8/2005 Wu et al. ..... 343/702
2004/0145521 A1 * 7/2004 Hebron et al. ..... 343/700 MS

* cited by examiner

*Primary Examiner*—Huedung Mancuso
(74) *Attorney, Agent, or Firm*—Holland & Hart

(57) ABSTRACT

A single feed multiple band planar antenna is provided. The planar antenna includes a radiating plate having a first end and a second end opposite the first end residing in spaced apart relating to a ground plane. A shorting post couples the radiating element to the ground plane and a feeding post couples the radiating plate to radio frequency power. The planar antenna further includes a second radiating plate having a first end and a second end where the first end of the second radiating plate coupled to the feeding post and substantially aligned with the first end of the first radiating plate and located between the first radiating plate and the ground plane.

20 Claims, 2 Drawing Sheets

SINGLE FEED DUAL-BAND PIFA REALIZED ON CIRCUIT BOARD

FIELD OF THE INVENTION

The present invention relates to planar antennas and, more particularly, to a single feed dual or multi-band planar inverted F antenna with independently tunable upper and lower frequencies.

BACKGROUND OF THE INVENTION

A conventional planar inverted F antenna ("PIFA") 100 is shown in FIGS. 1 and 2. PIFA 100 includes a radiating element 102 in spaced relation to a ground plane 104. Radiating element 102 comprises a radiating edge and a non-radiating edge. A shorting post 106 couples radiating element 102 to ground plane 104. A feed 108 supplies radio frequency power to radiating element 102. Radiating element 102 may have a slot 110 placed to quasi-partition radiating element and provide multi band frequency operation. Typically, radio frequency power is supplied through a via 112 in ground plane 104.

Conventionally, PIFA 100 can be tuned to operate at particular frequencies. Tuning is mostly accomplished by altering a length L or a width W of the radiating element. Slot 110 also influences the operating bands. Shorting post 106 and feed 108 also influence the operating frequencies of PIFA 100.

Sometimes, adjusting the length or width of the radiating element is a less than satisfactory solution for tuning the antenna. Additionally, using only a slot in the PIFA top plate typically does not produce enough bandwidth at the upper frequency band. Thus, it would be desirable to provide a multi band planar antenna with additional tuning features and improved bandwidth.

SUMMARY OF THE INVENTION

To attain the advantages of and in accordance with the purpose of the present invention, a planar antenna is provided. The planar antenna includes a first radiating plate having a first end and a second end opposite the first end residing in spaced apart relating to a ground plane. A shorting post couples the radiating element to the ground plane and a feeding post couples the radiating plate to radio frequency power. The planar antenna further includes a second radiating plate having a first end and a second end where the first end of the second radiating plate coupled to the feeding post and substantially aligned with the first end of the radiating plate and located between the radiating place and the ground plane. The planar antenna operates at a plurality of frequencies.

The foregoing and other features, utilities and advantages of the invention will be apparent from the following more particular description of a preferred embodiment of the invention as illustrated in the accompanying drawings.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION

The present invention will now be described with reference to FIGS. 3-5. While the present invention is described in relation to a dual band planar inverted F antenna, one of ordinary skill in the art will recognize that the present invention can be used in other types of antenna including tri-band and other multi-band antennas.

Figure 1:
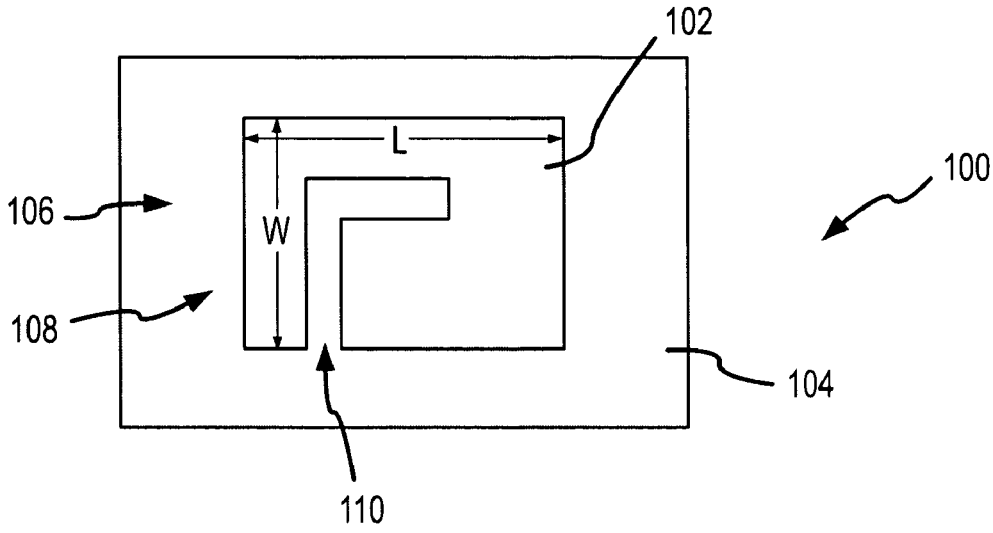
FIG. 1 is top side plan view of a planar inverted F antenna consistent with conventional devices.
Figure 2:
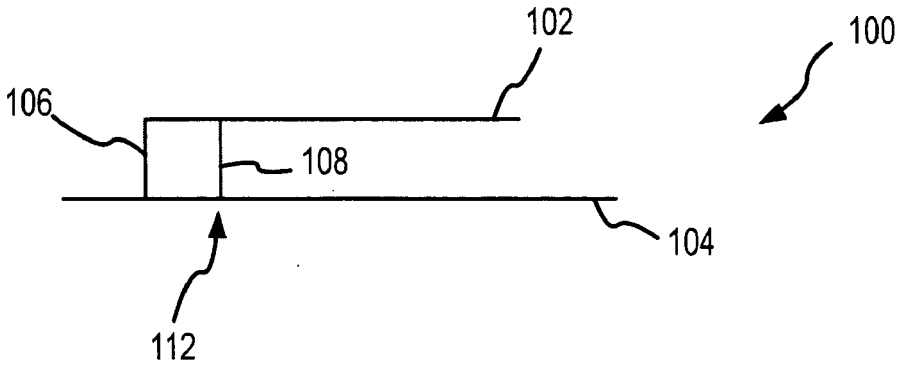
FIG. 2 is a side elevation view of the planar inverted F antenna shown in FIG. 1.
Figure 3:
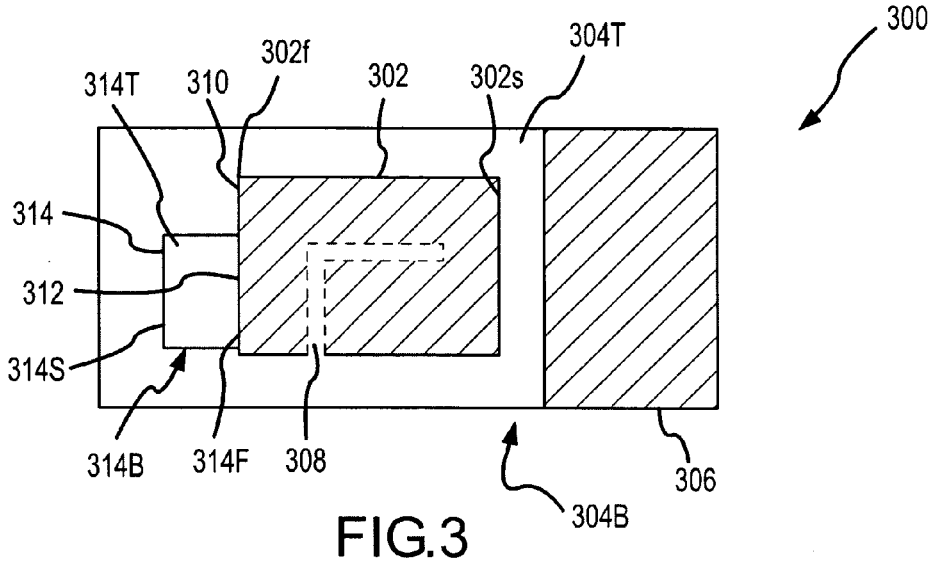
FIG. 3 is a top side plan view of a planar inverted F antenna consistent with an embodiment of the present invention.

Referring first to FIG. 3, a planar antenna 300 is shown. Planar antenna 300 is shown as an inverted F antenna. Planar antenna 300 includes a first radiating element 302 and a ground plane 304. The hash marks represent metalized portions, which are only shown in FIG. 3 for convenience. The metalized portions may be metalized in any conventional manner, such as, for example, etching, embossing, stamping, or plating. Ground plane 304 has a top side 304T and a bottom side 304B. Bottom side 304B is metalized while only a portion 306 of top side 304T is metalized in a conventional manner. If more than two bands of operation are desired for planar antenna 300, a slot 308 may be provided in first radiating element 302. Slot 308 is shown in phantom, as it is not necessary for dual band operation.

First radiating plate 302 has a first end 302F and a second end 302S opposite first end 302F. Connecting first radiating element 302 to ground plane 304 is a shorting post 310 (better seen in FIG. 5). Connecting first radiating element 302 to radio frequency power is feeding post 312 (also better seen in FIGS. 4 and 5). First radiating plate 302 extends from first end 302F (proximate the feeding post 312) to second end 302S (distal the feeding post 312) in a first direction A. Extending substantially parallel to first radiating element 302 is a second radiating plate 314, sometimes referred to as a capacitive plate. Second radiating plate 314 is space apart from first radiating element 302 towards ground plane 304 a distance D. While only a single second radiating plate 314 is shown for convenience, multiple plates are possible. Second radiating plate 314 has a first end 314F coupled to feeding post 312 and substantially aligned with first end 302F of first radiating plate 302. Second radiating plate 314 has a second end 314S opposite first end 314F. Second radiating plate 302 extends from first end 314F (proximate feeding post 312) to second end 314S (distal feeding post 312) in a second direction B opposite direction A. While shown parallel to first radiating plate 302, second radiating plate may be angled to converge or diverge from ground plane 304 distal feeding post 312.

Second radiating plate 314 has a top side 314T and a bottom side 314B. One or both sides of second radiating plate 314 may be metalized. In FIG. 3, top side 314T is not metalized.

Figure 4:
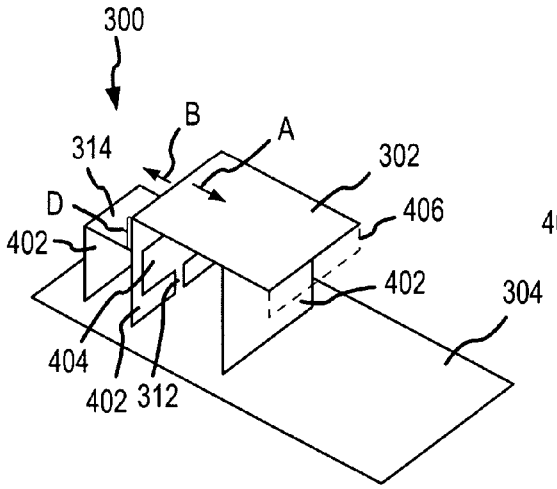
FIG. 4 is a top side perspective view of the planar inverted F antenna shown in FIG. 3.
Figure 5:
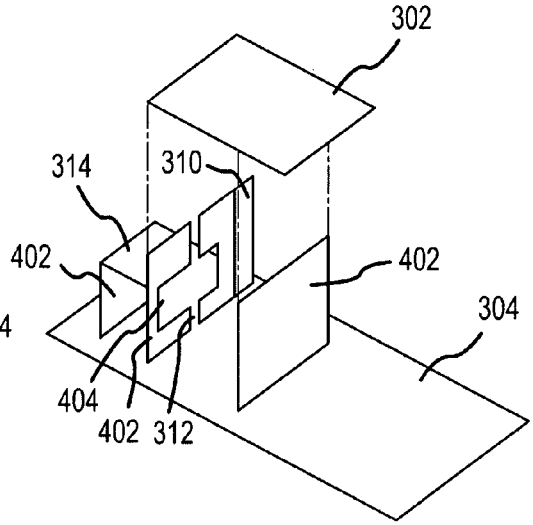
FIG. 5 is a partially exploded perspective view of the planar inverted F antenna shown in FIG. 3.

FIG. 4 is a perspective view of planar antenna 300. FIG. 4 does not show slot 308 as slot 308 is optional for additional band operation. As shown, one or more support walls 402 may be provided for structural stability. Support walls 402 typically are non-conducting. As shown in FIG. 4 (and better seen in FIG. 5), feeding post 312 has a matching network 404. As shown in phantom, first radiating element 302 may have on or more extensions 406. Extensions 406 may be tuning stubs, matching stubs, capacitive plates or the like.

Planar antenna 300 can be tuned to operate at particular frequencies. To tune the frequency band associated with first radiating plate 302, the length L and width W of the first radiating plate 302 can be adjusted. The frequency also can be adjusted by placement and width of the shorting post. Moreover, placement, length, shape, and width of slot 308 may be used to tune the frequency band associated with first radiating plate 302. To tune the frequency band associated with second radiating plate 314, the size (length and width) of second radiating plate 314 can be varied. Generally, first radiating plate 302 operates at a frequency lower than second radiating plate 314.

Shorting post 306 is placed a matching distance MD from feeding post 312. As the size of plate 302 varies, the distance MD varies to match the RF power. Second radiating plate 314 is matched by increasing or decreasing the size of matching network 404.

While the invention has been particularly shown and described with reference to an embodiment thereof, it will be understood by those skilled in the art that various other changes in the form and details may be made without departing from the spirit and scope of the invention.

What is claimed is:

1. A planar antenna, comprising:

a first radiating plate having a first end and a second end opposite the first end;

a ground plane such that the first radiating plate is aligned substantially above the ground plane;

a shorting post coupling the first radiating plate and the ground plane;

a feeding post coupling the first radiating plate to a radio frequency power source; and a second radiating plate having a first end and a second end; the first end of the second radiating plate coupled to the feeding post and substantially aligned with the first end of the first radiating plate and located between the first radiating plate and the ground plane, such that the planar antenna operates at a plurality of frequencies.

2. The planar antenna of claim 1, further comprising a slot in the first radiating element.

3. The planar antenna of claim 1, wherein the first radiating plate operates at a first frequency and the second radiating plate operates at a second frequency such that the first frequency is lower than the second frequency.

4. The planar antenna of claim 1, wherein the feeding post further comprises a matching network.

5. The planar antenna of claim 1, wherein the second radiating plate comprises a plurality of radiating plates.

6. The planar antenna of claim 2, wherein the second radiating plate comprises a plurality of second radiating plates.

7. The planar antenna of claim 1, wherein the second radiating plate is parallel to the first radiating plate.

8. The planar antenna of claim 1, wherein the second radiating plate extends between the first radiating plate and the ground plane.

9. The planar antenna of claim 1, wherein the operating frequency of the first radiating plate is adjusted by varying at least one of a length or a width of the radiating plate.

10. The planar antenna of claim 1, wherein the operating frequency of the first radiating plate is adjusted by varying at least one of a location or size of at least one of the feeding post or the shorting post.

11. The planar antenna of claim 9, wherein the operating frequency of the first radiating plate is further adjusted by varying at least one of a location or size of at least one of the feeding post or the shorting post.

12. The planar antenna of claim 1, wherein the operating frequency of the second radiating plate is adjusted by varying at least one of a length and a width of the second radiating plate.

13. The planar antenna of claim 1, wherein the second radiating plate is angled with respect to the first radiating plate.

14. The planar antenna of claim 1, wherein the planar antenna is a planar inverted-F antenna.

15. The planar antenna of claim 1, further comprising structural supports.

16. A planar inverted-F antenna, comprising:

a radiating element;

a ground plane;

a capacitive element;

a feeding post coupling the radiating element and the capacitive element to radio frequency power;

a shorting post coupling the radiating element to the ground plane;

the radiating element having a first end proximate the feeding post and a second end opposite the first end and distal the feeding post such that the radiating element extends from the first end to the second end in a first direction; and the capacitive element having at least a first position proximate the feeding post and substantially aligned beneath the first end of the radiating element and a second end distal the feeding post such that the capacitive element extends from the first end to the second end in a second direction.

17. The planar inverted-F antenna of claim 16, wherein the first direction and the second direction are different directions.

18. The planar inverted-F antenna of claim 16, wherein the first direction and the second direction are identical.

19. The planar inverted-F antenna of claim 16, wherein capacitive element has a portion beneath the radiating element.

20. The planar inverted-F antenna of claim 16, further comprising an extension coupled to the radiating element.

* * * * *